United States Patent [19]

Vargo

[11] Patent Number: 4,741,720

[45] Date of Patent: May 3, 1988

[54] COIN LOADER

[76] Inventor: Steve P. Vargo, 3800 SW. 142nd Ave., Davie, Fla. 33330

[21] Appl. No.: 17,530

[22] Filed: Feb. 24, 1987

[51] Int. Cl.[4] ..... B65B 1/04; B65B 35/50

[52] U.S. Cl. ..... 453/58; 453/59; 53/213; 53/254; 53/532

[58] Field of Search ..... 453/58, 59, 60; 53/212, 53/213, 254, 532

[56] References Cited

U.S. PATENT DOCUMENTS

| | | | |
|---|---|---|---|
| 1,274,615 | 8/1918 | Sherwood | 53/532 X |
| 2,150,473 | 3/1939 | Wagner | 133/1 |
| 2,996,864 | 8/1961 | Cook | 53/212 X |
| 3,085,378 | 4/1963 | Howard | 453/59 X |
| 3,093,148 | 6/1963 | Mesthos | 453/60 |
| 4,244,157 | 1/1981 | Vondra et al. | 53/254 |
| 4,407,313 | 10/1983 | Ventura | 133/8 |
| 4,606,360 | 8/1986 | Mills | 453/59 |

FOREIGN PATENT DOCUMENTS

| | | | |
|---|---|---|---|
| 221602 | 11/1958 | Australia | 453/59 |
| 59489 | 6/1913 | Fed. Rep. of Germany | 453/60 |

*Primary Examiner*—Joseph J. Rolla

*Attorney, Agent, or Firm*—Oltman and Flynn

[57] ABSTRACT

Three simply constructed plastic tubes form a time saving coin wrapping system. The first component is a clear plastic base used for holding a stack of similar coins. The second component is a transfer tube made of a resilient split plastic rolled sheet. This transfer tube is inserted down around the coins while in the base. Finally, a third component, a resilient plastic casing which holds a paper coin wrapper, is inserted in the top of the transfer tube. The entire assembly is inverted. The coins can now be removed neatly wrapped in the paper coin wrapper.

8 Claims, 2 Drawing Sheets

COIN LOADER

FIELD OF THE INVENTION

The present invention relates to manually operated paper coin wrapper loaders.

BACKGROUND OF THE INVENTION

Sliding coins down paper coin wrappers is a time consuming procedure requiring considerable dexterity. The paper wrappers themselves tend to collapse while holding them. This makes inserting the coins and holding them perpendicular to the paper coin wrapper quite difficult.

SUMMARY OF THE INVENTION

The object of the present invention is to provide a columnar base capable of holding a predetermined number of like coins to be wrapped.

Another object of the present invention is to provide a transfer tube capable of transferring the stacked coins in the columnar base into the paper coin wrapper by inserting the columnar base.

Another object of the present invention is to provide a removable wrapper casing capable of holding the loaded coin wrapper while the paper ends of the coin wrapper are folded shut.

Another object of the present invention is to allow the transfer tube and removable wrapper to provide a similar three step coin wrapping function as above even without the columnar base.

Other objects of this invention will appear from the following description and appended claims, reference being had to the accompanying drawings forming a part of this specification wherein like reference characters designate corresponding parts in the several views.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DETAILED DESCRIPTION

Figure 1:
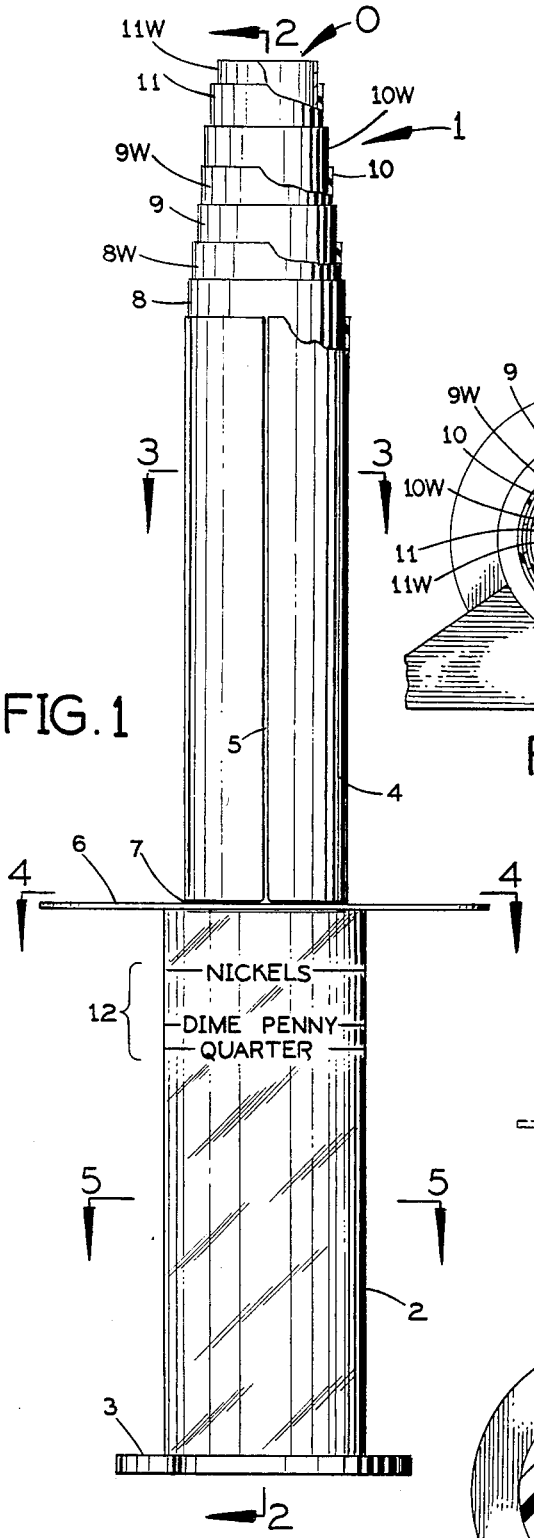
FIG. 1 shows a front elevational view of the coin loader with the several different coin wrappers pulled up for identification.

Referring first to FIG. 1, the coin loader 1 comprises a columnar base 2. A flange 3 is integral to columnar base 2 for providing support for the coin loader 1 even when loaded with coins (see FIG. 9). Columnar base 2 preferably is made of transparent plastic. Transfer tube 4 is inserted down columnar base 2 and protrudes up above columnar base 2 approximately the height of a ten dollar quarter wrapper, four inches. The depth of columnar base 2 is about three and one half inches. Columnar base 2 has calibrated markings 12 for determining the proper height to stack quarters, nickels, dimes and pennies to fill their respective wrapper.

Removable quarter wrapper casing 8 surrounds quarter wrapper 8W. In a telescoping fashion the smaller coin wrapper 9W for nickels and 10W for pennies and 11W for dimes are surrounded by their respective wrapper casings 9, 10 and 11. All the above coin wrappers and casings, 8, 8W, 9, 9W, 10, 10W and 11, 11W slide into the top of transfer tube 4. At this time, as shown in FIG. 1, the top of transfer tube 4 is sprung slightly open along slit 5, thereby providing a firm support for assembly 8, 8W, 9, 9W, 10, 10W, 11 and 11W. Transfer tube 4 and coin wrapper casings 8, 9, 10 and 11 are preferably constructed of split plastic resilient tubes so that they will fit different size wrappers.

Figure 9:
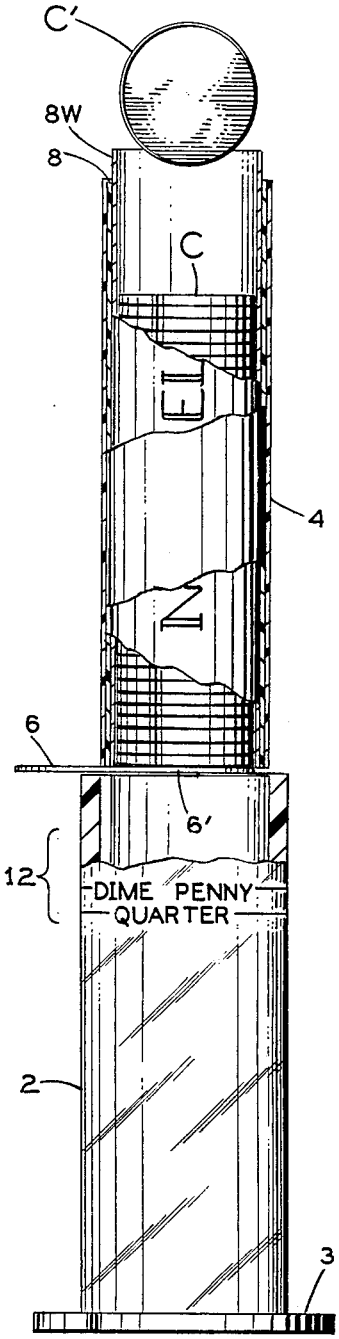
FIG. 9 is a front elevational view of the coin loader with the upper transfer tube partially cut away to view the loaded coins resting atop the temporary stopper.

At this point we are ready to roll dimes. The first step is to remove transfer tube 4 from columnar support 2. Next we fill columnar base 2 with dimes up to the proper marking at 12. We then insert transfer tube 4 having assembly 8, 8W, 9, 9W, 10, 10W, and 11, 11W integral therein and fully inserted into transfer tube 4 right to the top of columnar base 2 shown at slit 7 of the transfer tube 4 (best seen in FIG. 6). Next we simply invert the coin loader 1 while holding a finger inside opening O to prevent the coins from falling out. It may be necessary to push the coins down into the top of transfer tube 4 from the bottom B of transfer tube 4 (see FIG. 6). Once the coins are inside the top of transfer tube 4, dime wrapper casing 11, dime wrapper 11W and the dimes (as illustrated in FIG. 9) are removed intact. The ends of dime wrapper 11W are folded in a traditional manner. The last step is simply to slide dime wrapper casing 11 off the loaded dime wrapper 11W.

The same procedure can then be repeated for pennies, nickels and quarters. If it is necessary to load only one denomination of coins such as quarters, then the first step is to remove the unnecessary inner coin wrappers and casings 9, 9W, 10, 10W, 11 and 11W.

The user may decide to stop half way through the above procedure. When the coin loader is inverted and loaded with any number of coins, user may insert stopper 6 in slit 7 as shown in FIGS. 1, 2, 3, 4 and 9. Stopper 6 supports the column of coins C as seen in FIG. 9.

Figure 2:
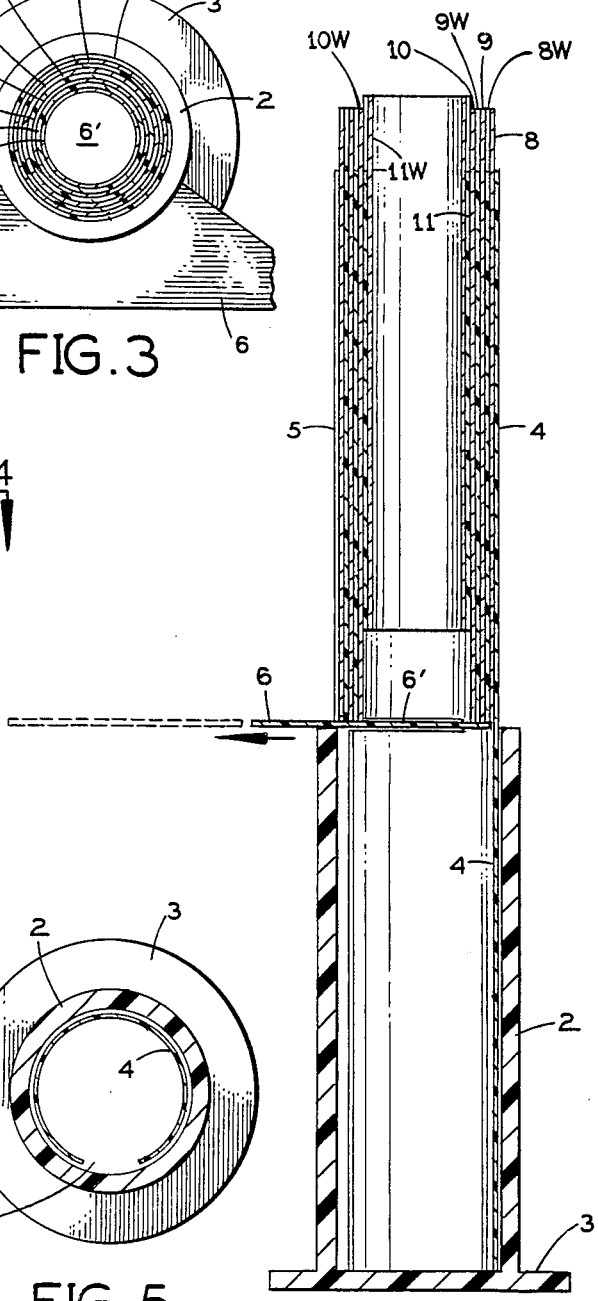
FIG. 2 is a longitudinal sectional view of the coin loader taken along line 2—2 of FIG. 1.
Figure 7:
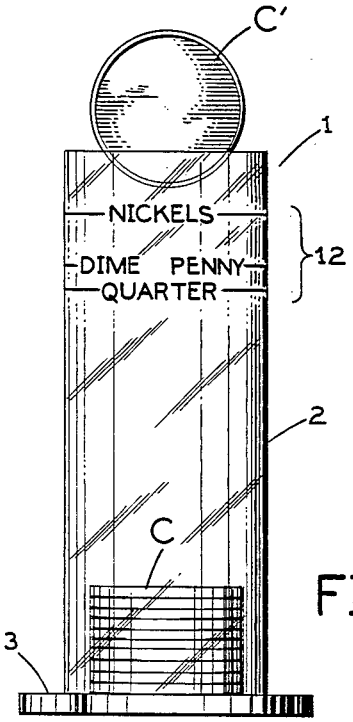
FIG. 7 is a front elevational view of the columnar base showing the calibrated markings for the various coins.

FIG. 2 shows how transfer tube 4 fits down into columnar support 2. Coin loader 1 is now ready to roll dimes since dime wrapper 10W is the innermost wrapper at the top of transfer tube 4. The procedure is simply to remove transfer tube 4, fill columnar support 2 with dimes as seen in FIG. 7 and slip transfer tube 4 over the dimes. Inverting coin loader 1 will result in transferring the dimes into dime wrapper 10W as seen in FIG. 9. Removal of coin wrapper 10W, casing 10 and finally folding the ends of coin wrapper 10W complete the job.

Figure 3:
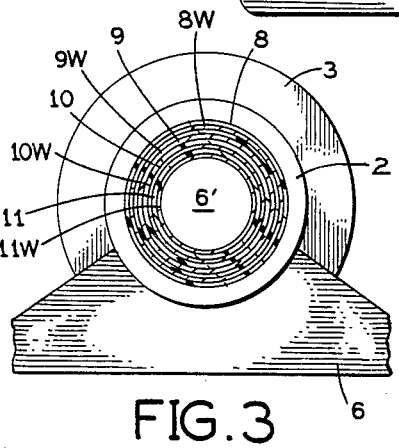
FIG. 3 is a cross-sectional view of the top of the coin loader taken along line 3—3 of FIG. 1.

FIG. 3 shows how stopper 6 forms a base 6' for coins at the bottom of assembly 4, 8, 8W, 9, 9W, 10, 10W 11 and 11W.

Figure 4:
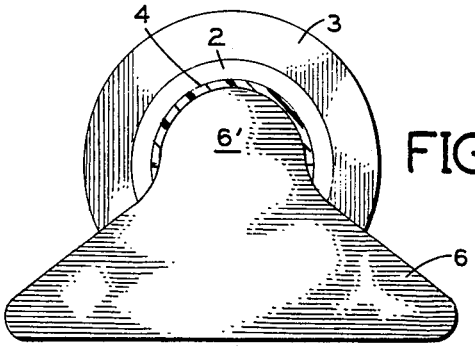
FIG. 4 is a cross-sectional view of the coin loader with the temporary stopper inserted per line 4—4 of FIG. 1.

FIG. 4 shows the basic shape of stopper 6 having base 6' for coins as shown in FIG. 9.

Figure 5:
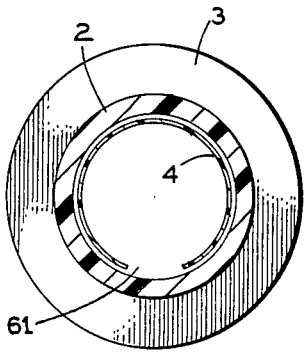
FIG. 5 is a cross-sectional view of the columnar base of the coin loader taken along line 5—5 of FIG. 1.

FIG. 5 shows how the bottom of transfer tube 4 has a slot 61 which facilitates sliding transfer tube 4 over the top of a column of coins C as shown in FIG. 7.

Figure 6:
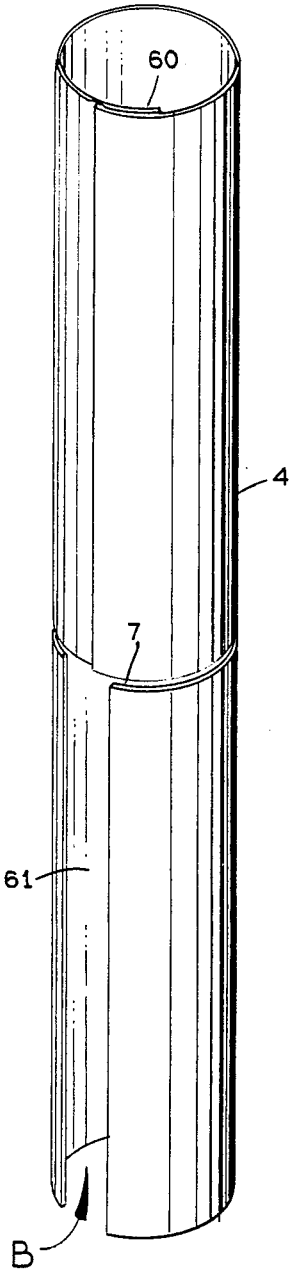
FIG. 6 is a front perspective view of the transfer tube standing alone.

FIG. 6 shows transfer tube 4 standing alone. Overlap 60 on top supports assembly 8, 8W, 9, 9W, 10, 10W, 11 and 11W as seen in FIGS. 1, 2 and 9 by the resilient spring strength of transfer tube 4.

FIG. 7 shows the first step in utilizing coin loader 1. Coin C' is dropped into columnar support 2 to form column C.

Figure 8:
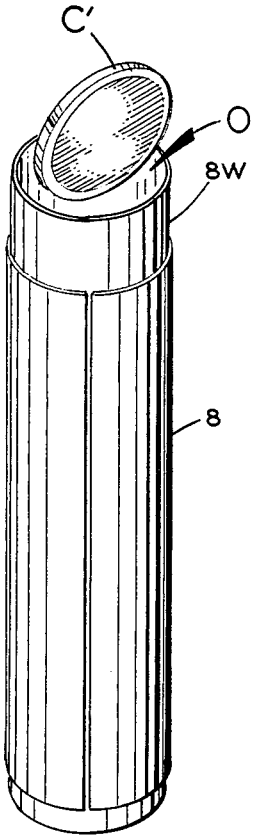
FIG. 8 is a perspective view of the removable wrapper casing holding a paper wrapper.

FIG. 8 shows how a coin C' can be manually placed into coin wrapper 8W when it is encased by coin wrapper casing 8.

FIG. 9 shows how stopper 6 supports coin column C to allow the user to stop in the middle of the coin wrapping procedure.

It is noted that at least two shortened procedures may be used with the present invention. However, each requires the precise counting of coins as well as more dexterity. The first alternate procedure merely eliminates the columnar base 2 altogether. The coins are first counted and stacked on a flat surface. The loading procedure above is then commenced. The second alternate procedure is to additionally eliminate the transfer tube 4. Coins are merely inserted into the paper coin wrapper while encased in the appropriate coin wrapper casing.

I claim:

1. A coin loader for wrapping a column of coins into a paper coin wrapper, comprising:

a columnar base;

a transfer tube having a height greater than the height of said base;

at least one coin wrapper casing;

at least one paper coin wrapper; said transfer tube and coin wrapper casing further comprising split resilient tube surfaces such that they encircle the column of coins;

said columnar base having a vertical column with an inner diameter slightly wider than said transfer tube such that said transfer tube slides into said vertical column and protrudes above said columnar base; and said coin wrapper casing having a diameter to encase the paper coin wrapper and slidingly engage the inside of the top of said transfer tube, wherein coins stacked in a columnar fashion inside said vertical column of said columnar base are encased in the bottom of said transfer tube when said transfer tube is inserted therein, and upon inversion and removal of said transfer tube from said columnar base, said coins are transferred by gravity from the bottom of the transfer tube to the inside of the coin wrapper which is in turn encased by the coin wrapper casing and the top of the transfer tube, whereby the coin wrapper casing may be removed from the top of the transfer tube while holding the coin wrapper and coins;

said coin wrapper casing encircling a plurality of smaller circumference coin wrapper casings which in turn encircle their respective paper coin wrappers, thereby enabling the loading of various denomination coins in ascending sequence according to their respective diameter.

2. The coin loader of claim 1, wherein the columnar base is transparent and has calibrations for various denominations of coins for filling their respective paper coin wrappers.

3. The coin loader of claim 1, wherein the transfer tube has a slot perpendicular to its length at a point just above the top of the columnar base when inserted therein.

4. The coin loader of claim 3, wherein a stopper fits into the slot functioning to support a column of coins at the top of the transfer tube.

5. A coin loader for wrapping a column of coins into a paper coin wrapper, comprising:

a base having a hollow vertical cylinder;

a transfer tube having a height greater than the height of said base and slidingly engaged inside the hollow vertical cylinder and protruding above the base;

a coin wrapper casing slidingly engaged inside the top of the transfer tube; and said coin wrapper casing encircling the paper coin wrapper, wherein coins are stacked inside the vertical cylinder of the base and the transfer cylinder is slidingly engaged down the hollow vertical cylinder thereby encircling the coins, whereupon the coin loader is inverted causing the coins to fall into the coin wrapper casing, and lastly the coin wrapper casing is removed from the transfer tube functioning to hold the paper coin wrapper and coins until the paper ends of the paper coin wrapper are folded and the paper coin wrapper is removed from the coin wrapper casing ;

said coin wrapper casing encircling a plurality of smaller circumference coin wrapper casings which in turn encircle their respective paper coin wrappers, thereby enabling the loading of various denomination coins in ascending sequence according to their respective diameters.

6. The coin loader of claim 5, wherein the base is transparent and has calibrations for various denominations of coins for filling their respective paper coin wrappers.

7. The coin loader of claim 5, wherein the transfer tube has a slot perpendicular to its length at a point just above the top of the base when inserted therein.

8. The coin loader of claim 7, wherein a stopper fits into the slot functioning to support a column of coins at the top of the transfer tube.

* * * * *